US005125805A

United States Patent [19]

Fujiwara et al.

[11] Patent Number: 5,125,805

[45] Date of Patent: Jun. 30, 1992

[54] FLUID COMPRESSOR

[75] Inventors: Takayoshi Fujiwara, Kawasaki; Hisanori Honma; Yoshinori Sone, both of Yokohama; Takuya Hirayama, Fujisawa, all of Japan

[73] Assignee: Kabushiki Kaisha Toshiba, Kawasaki, Japan

[21] Appl. No.: 683,040

[22] Filed: Apr. 10, 1991

[30] Foreign Application Priority Data

Apr. 13, 1990 [JP] Japan ..... 2-096305

[51] Int. Cl.[5] ..... F04B 35/04

[52] U.S. Cl. ..... 417/356; 417/365; 418/55.3; 418/220; 464/104

[58] Field of Search ..... 417/355, 356, 357, 365; 418/55.3, 220; 464/102, 104, 106

[56] References Cited

U.S. PATENT DOCUMENTS 2,401,189 5/1956 Quiroz ..... 418/220
4,871,304 10/1989 Iida et al. ..... 418/220
5,026,264 6/1991 Morozumi et al. ..... 417/356

FOREIGN PATENT DOCUMENTS 2-201095 8/1990 Japan ..... 417/356

*Primary Examiner*—Richard A. Bertsch
*Assistant Examiner*—Charles G. Freay
*Attorney, Agent, or Firm*—Cushman, Darby & Cushman

[57] ABSTRACT

The Oldam-ring of the rotational force transmitting mechanism of a fluid compressor is engaged with the rectangular section formed on the base portion of the main shaft of the rotary rod in the direction perpendicular to the axial direction of the main shaft to achieve an easy assembling of the Oldam-ring to the rectangular section. If the fluid compressor employs a thrust force canceling system wherein the thrust force acting on the rotary rod from the discharge side toward the suction side of a cylinder is canceled by a counter thrust force, the diameter of the main shaft located at the suction side is increased compared with that of the conventional fluid compressor to increase the counter thrust force acting on the edge surface of the main shaft whereby the thrust force can be effectively canceled.

13 Claims, 4 Drawing Sheets

FLUID COMPRESSOR

BACKGROUND OF THE INVENTION

1. Field of the invention the present invention relates to fluid compressors. In particular, the invention relates to a fluid compressor used in a refrigerating circuit for compressing refrigerant, for example.

2. Description of the Related Art

In recent years, various fluid compressors which have an enhanced sealing ability with a relatively simple construction and thus are easily assembled have been considered. One example of such fluid compressors is shown in FIG. 1. A conventional fluid compressor 11 includes a casing 13, compressing unit 15 located in casing 13 and a driving unit 17, i.e., a motor for driving compressing unit 15. Driving unit 17 includes an annular stator 19 fixed to the inner circumferential surface of casing 13 and an annular rotor 21 arranged inside stator 19. Rotor 21 is fixed to the outer circumferential surface of a cylinder 23 of compressing unit 15 arranged in casing 13 coaxially with casing 13. The outer surface of rotor 21 faces the inner circumferential surface of stator 19 separated a distance from each other.

One of the open ends of cylinder 23 is rotataly supported and airtightly closed by a main bearing 25 fixed to the corresponding end of casing 13. The other end of cylinder 23 is also supported and airtightly closed by an auxiliary bearing 27 fixed to the corresponding end of casing 13. In this case, the other end of cylinder 23 is elastically supported by an elastic support element 29 disposed between the inner circumferential surface of cylinder 23 and the outer circumferential surface of auxiliary bearing 13. Thus, the other end of cylinder 23 can be moved within a certain extent.

A columnar rotary rod 31, the diameter of which is smaller than the inner diameter of cylinder 23, is arranged in the axial direction of cylinder 23. Rotary rod 31 is located with its central axis A eccentric by the distance e with respect to the central axis B of cylinder 23. A part of rotary rod 31 is in contact with the inner circumferential surface of cylinder 23 along the axial direction thereof. Rotary rod 31 acts as a piston in compressing unit 15. The right end portion of rotary rod 31 is rotatably inserted in bearing hole 25*a* formed in main bearing 25. The left end of rotary rod 31 also is rotatably inserted in bearing hole 27*a* of auxiliary bearing 27. These bearing holes 25*a* and 27*a* are coaxially fromed with one the other and are eccentrically located by the distance e to the axis of cylinder 23.

As shown in FIG. 1, rotational force transmitting mechanism Sa is provided at the right end portion of rotary rod 31. Rotational force transmitting mechanism Sa includes a rectangular section 33 formed to main shaft 31*a* of rotary rod 31, an Oldham-ring 35 and an Oldham-ring receiver 37 shown in FIG. 2. A relative rotation is carried out between cylinder 23 and rod 31 (piston) when cylinder 23 is rotationaly driven by driving unit 17. This is because the rotational force is transmitted from cylinder 23 to rotary rod 31 through rotational force transmitting mechanism Sa.

The construction of the conventional rotational force transmitting mechanism Sa will be described in more detail with reference to FIG. 2. Main shaft 31*a* (the right end portion), whose diameter is smaller than that of rotary rod 31, coaxially extends from rotary rod 31. As stated above, main shaft 31*a* is rotatably inserted in bearing hole 25*a* of main bearing 25. The above-described rectangular section 33 is formed at the extending base portion of main shaft 31*a*. The width and length (a direction perpendicular to the width direction) of rectangular section 33 in cross-section are the same, i.e., a, and are substantially equal to or slightly greater than the diameter dϕ of main shaft 31*a*. Oldham-ring 35 is formed in a disc shape of a certain thickness, and the diameter thereof is substantially equal to that rotary rod 31. A rectangular-shaped hole 39 is formed at the central portion of Oldham-ring 35. The length of hole 39 is substantially equal to that of rectangular section 33, as indicated in an alphabetical symbol a, and the width thereof is greater than that of rectangular section 33, as indicated in an alphabetical symbol b in FIG. 2. First and second opposite rectangular grooves 41*a* and 41*b* are formed in one surface of Oldham-ring 35 at opposite sides of hole 39 along the length direction of hole 39.

The above-described Oldham-ring receiver 37 is formed in a disc shape whose diameter is substantially equal to the inner diameter of cylinder 23 so that the outer edge surface of receiver 37 is fixed to the inner circumferential surface of cylinder 23. A rectangular-shaped guide hole 43 is formed at the central portion of receiver 37. The width and the length of guide hole 43 are the same and are equal to the width of hole 39 of Oldham-ring 35, as indicated in an alphabetical symbol b in FIG. 2. First and second opposite rectangular projections 45*a* and 45*b* are integrally formed on the surface of Oldham-ring receiver 37 at opposite sides of guide hole 43 along the length direction of hole 43. First and second opposite rectangular projections 45*a* and 45*b* are slidably fitted into the corresponding first and second grooves 41*a* and 41*b*, respectively when Oldham-ring 35 is mounted on Oldham-ring receiver 37. Assembled Oldham-ring 35 and Oldham-ring receiver 37 are mounted on main shaft 31*a* through holes 39 and 43 and holes 39 and 43 are finally engaged with the outer surface of rectangular section 33. Then, rotary rod 31 on which Oldham-ring 35 and Oldham-ring receiver 37 are assembled is inserted into cylinder 23 and Oldham-ring receiver 37 is fixed to a prescribed position in cyldinder 23.

A spiral groove 47 is formed on the circumferential surface of rotary rod 31. Spiral groove 47 extends from one end to the other end of rotary rod 31. As shown in FIG. 1, the pitch of spiral groove 47 is gradually narrowed with a distance from the suction side (right end) toward the discharge side (left end) of rotary rod 31.

A spiral blade 49 is fitted in spiral groove 47. The thickness of spiral blade 49 is substantially the same as the width of groove 47 and blade 49 is movable along groove 47 in the radial direction of rotary rod 31. The outer surface of blade 49 slide s on the inner circumferential surface of cylinder 23 while it is forcibly in contact therewith.

The space between the inner circumferential surface of cylinder 23 and the outer circumferential surface of rotary rod 31 is divide into a plurality of operation chambers 51 by spiral blade 49. Each operation chamber 51 is defined by two adjacent turns of spiral blade 49. The volumes of operation chambers 51 are gradually reduced from the suction side toward the discharge side of cylinder 23.

A suction hole 53 extends through main bearing 25 in the axial direction of cylinder 23. One of the ends of suction hole opens inside cylinder 23 and the other end is connected to a suction tube 55 of a refrigerating circuit (not shown) for a fluid communication.

A discharge hole 57 is formed in a portion of cylinder 23 close to auxiliary bearing 27. One end of hole 57 opens the inside of operation chamber 51 having a smallest volume and the other end thereof opens the inside of casing 13. A discharge tube 59 is connected to casing 13 for a fluid communication.

The construction of a thrust force cancel system will be described. A first pressure pass 61 is formed in main bearing 25. One end of first pressure pass 61 opens the inside casing 13 and the other end opens bearing hole 25*a* of main bearing 25. A second pressure pass 63 is formed in rotary rod 31. One end of second pressure pass 63 opens bearing hole 27*a* of auxiliary bearing 27 and the other end opens one of the operating chambers 51*a* defined by the edge surface of main bearing 25 and spiral blade 49. The suction pressure in one of the operational chambers 51*a* is supplied to bearing hole 27*a* through second pressure pass 63 and thus the suction pressure (smaller than the discharge pressure) is applied to the edge surface of auxiliary shaft 31*b*. The discharge pressure in casing 13 also is supplied to bearing hole 25*a* through first pressure pass 61 and thus the discharge pressure (greater than the suction pressure) is applied to the edge surface of main shaft 31*a*.

In the above-describe conventional fluid compressor 11, when driving unit 17 is energized, cylinder 23 is rotated as rotor 21 rotates. The rotational force of cylinder 23 is transmitted to rotary rod 31 through rotational force transmitting mechanism Sa, and blade 49 also is rotated together with cylinder 23. While rotating, blade 49 maintains the contact between the outer surface thereof and the inner circumferential surface of cylinder 23. Therefore, each part of blade 49 is pushed successively into groove 47 as it becomes closer to each contact point between the outer circumferential surface of rod 31 and the inner circumferential surface of cylinder 23 and emerges from groove 47 as it goes away from the contact point. Meanwhile, as compressing unit 15 is operated, a gaseous refrigerant is drawn into cylinder 23 through suction tube 55 and suction hole 53. The gaseous refrigerant from suction tube 55 is first confined in one of the operating chambers 51*a* nearest to the suction end of cylinder 23. The gaseous refrigerant confined in operating chamber 51 is transmitted toward the discharge side and is compressed, as rotary rod 31 rotates. The compressed gaseous fluid is finally discharge into the inside of casing 13 through discharge hole 57.

In the construction of the above-described conventional fluid compressor, Oldham-ring 35 and Oldham-ring receiver 37 of rotational force transmitting mechanism Sa are inserted from the edge of main shaft 31*a* and are moved along main shaft 31*a* to engage with rectangular section 33. However, such inserting and moveing operations are troublesome.

Furthermore, in the above-described compressing operation, since a gaseous refrigerant is compressed along the axial direction of cylinder 31, a thrust force acts on rotary rod 31 from the discharge side toward the suction side (from the left hand side toward the right-hand side in FIG. 1). Rotary rod 31 is pushed toward main bearing 25 by the thrust force and is in contact with main bearing 25. A frictional losses occur by the sliding rotation between rotary rod 31 and main bearing 25.

However, since the conventional fluid compressure 13 employs the thrust force cancel system, the discharge pressure is applied to the edge surface of main shaft 31*a* through first pressure pass 61 and the suction pressure is applied to the edge surface of auxiliary shaft 31*b* through second pressure pass 63. A force occurs in the direction reverse to that of the thrust force, and thus the force is balanced with thrust force.

It is required to increase the area of the edge surface of main shaft 31*a* to increase the pressure acting on the edge surface of main shaft 31*a*. However, since Oldham-ring 35 and Oldham-ring receiver 37 are assembled through main shaft 31*a*, the width and length of rectangular section 33 should be increased if the diameter d$\phi$ of main shaft 31*a* is increased. On the other hand, if the inner diameter of cylinder 23 is increased, the external shape of fluid compressor 11 is also increased. Thus, it is undesirable to increase the inner diameter of cylinder 23. This means that it is difficult to increase the diameter of Oldham-ring 35 and Oldham-ring receiver 37. However, if the diameter of main shaft 31*a* is increased, it is necessary to increase the diameter of Oldham-ring 35 and Oldham-ring receiver 37 to form hole 39 and guide hole 43.

When the above-described circumstances are taken into consideration, it is difficult to increase the diameter of main shaft 31*a* in the conventional fluid compressor.

SUMMARY OF THE INVENTION

It is an object of the present invention to easily engage the Oldam-ring and Oldam-ring receiver of a rotational force transmitting mechanism with the rectangular section of a rotary rod in a fluid compressor.

It is another object of the present invention to increase the area of the edge surface of the main shaft of a rotary rod of a fluid compressor employing a thrust force cancel system without increasing the external shape of the fluid compressor.

To acomplish the above-describe objects, a fluid compressor includes a rotatable cylinder, a driving unit for generating a rotational force applied to the cylinder, first and second bearings for respectively supporting the suction and discharge side of the cylinder, a rotatable compressing unit disposed in the cylinder for compressing refrigerant from the suction side toward the discharge side of the cylinder and a rotational force transmitting mechanism for transmitting the rotational force from the cylinder to the compressing unit. The transmitting mechanism includes a rectangular section formed between the main body of the compressing unit and the first shaft of the compressing unit, an Oldam-ring engaged with the rectangular section from the direction perpendicular to the first shaft, and an Oldam-ring receiver, by which the Oldam-ring is supported, engaged with the rectangular section from the direction perpendicular to the first shaft.

The Oldam-ring may include a disk-shaped body, a rectangular shaped engaging hole, whose one side is opened, at the center of the disk-shaped body, and a pair of grooves each formed on the disk-shaped body from the opposite sides of the engaging hole.

The Oldam-ring receiver may include a second disk-shaped body whose diameter is substantially equal to the inner diameter of the cylinder, a rectangular shaped guide hole, whose one side is opened, at the center of the second disk-shaped body, and a pair of projections each formed on the second disk-shaped body from the opposite sides of the guide hole, the pair of projections being engaged with the pair of grooves of the Oldham-ring so that the open side of guide hole is coincident with the open end of the engaging hole, the Oldham-ring receiver by which the Oldham-ring is supported being engaged with the rectangular section through the open side of the engaging hole in the direction perpendicular to the first shaft.

BRIEF DESCRIPTION OF THE DRAWINGS

These and other objects and advantages of this invention will become more apparent and more readily appreciated from the following detailed description of the presently preferred exemplary embodiments of the invention, taken in conjunction with the accompanying drawings, wherein the same reference numerals throughout the various figures denote like structure elements and wherein.

DETAILED DESCRIPTION OF THE PREFERRED EMBODIMENTS

Figure 1:
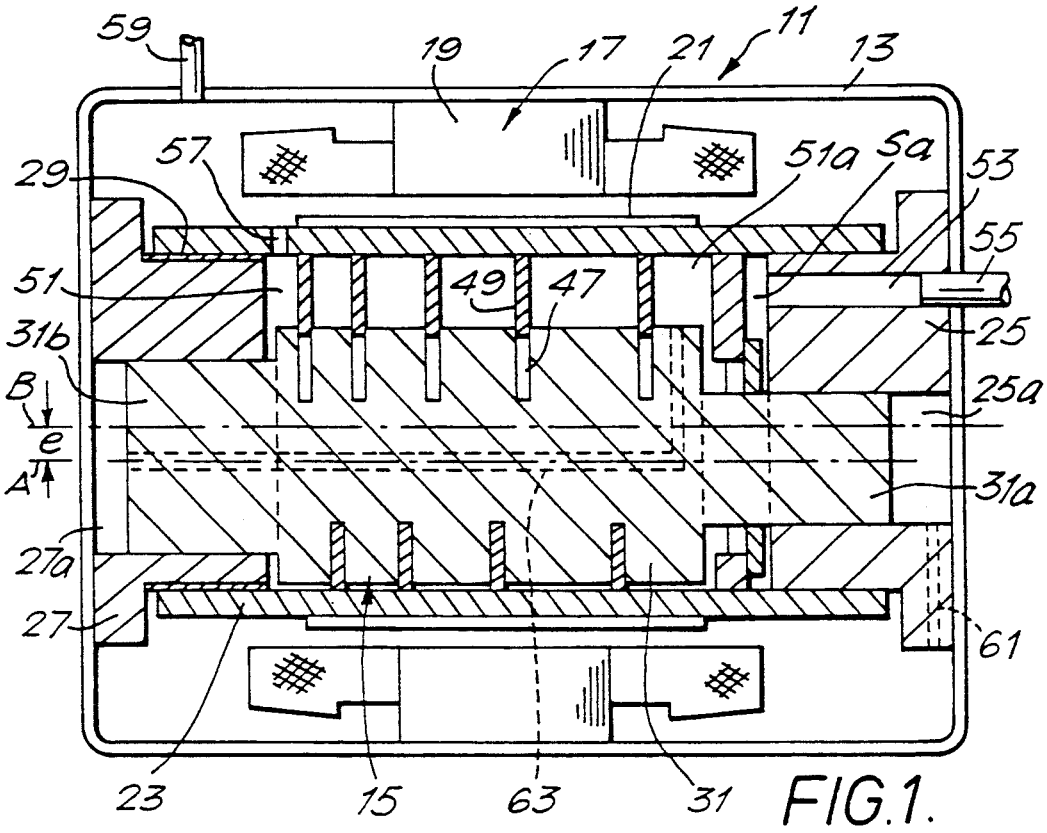
FIG. 1 is a cross sectional view illustrating a conventional fluid compressor.
Figure 2:
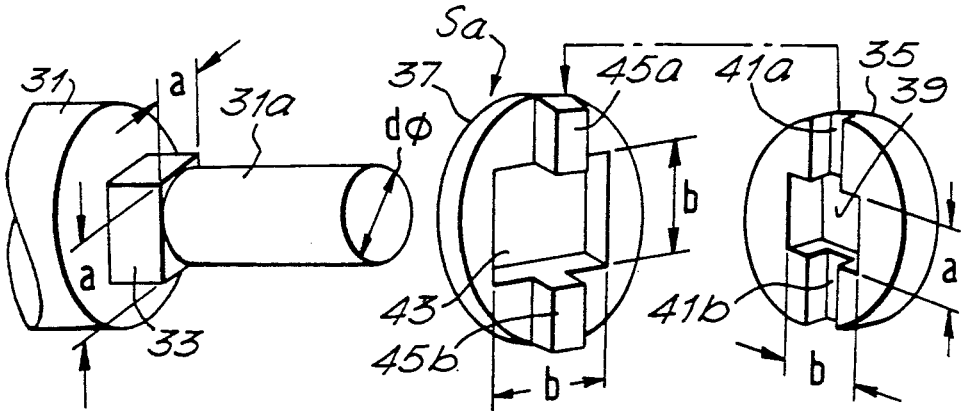
FIG. 2 is an exploded perspective view illustrating a rotational force transmitting mechanism of the conventional fluid compressor shown in FIG. 1 with a main shaft of a rotary rod.

Preferred embodiments of the present invention will now be described in more detail with reference to the accompanying drawings. However, the construction of a fluid compressor of one embodiment except the construction of a rotational force transmitting mechanism S is similar to that of the conventional fluid compressor shown in FIG. 1. The same reference numerals are applied to the similar elements, and therefore the detail descriptions thereof are not repeated.

Figure 3:
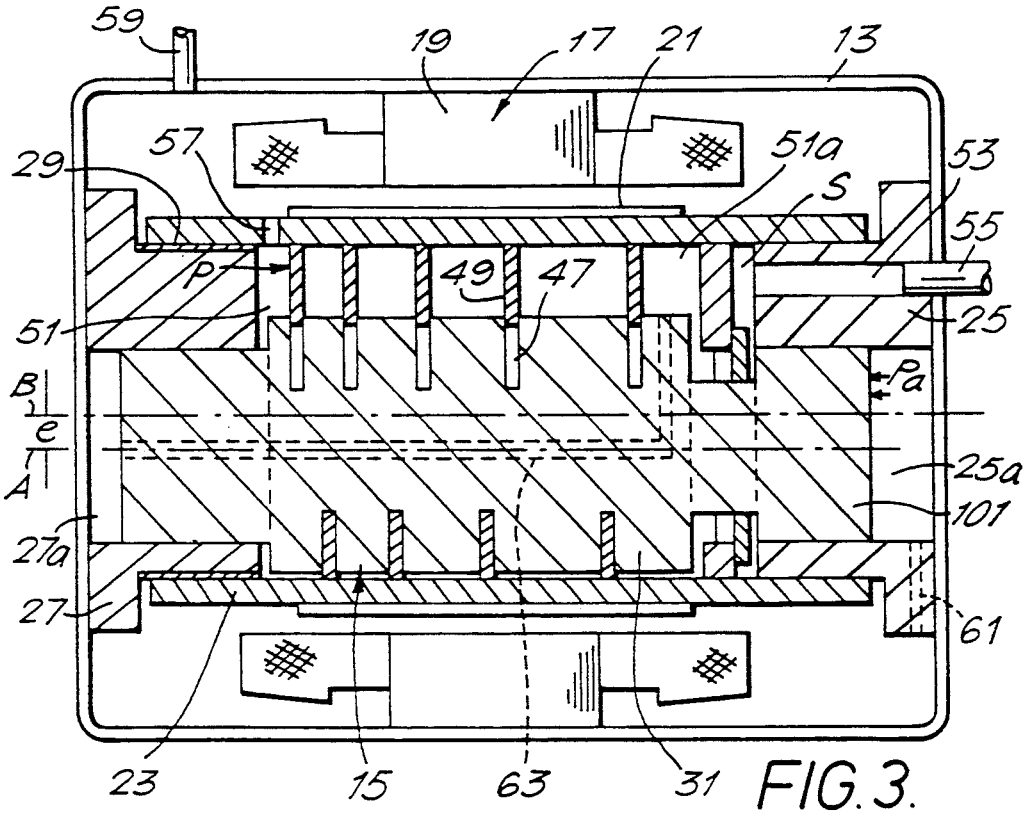
FIG. 3 is a cross sectional view illustrating a fluid compressor of one embodiment of the present invention.
Figure 4:
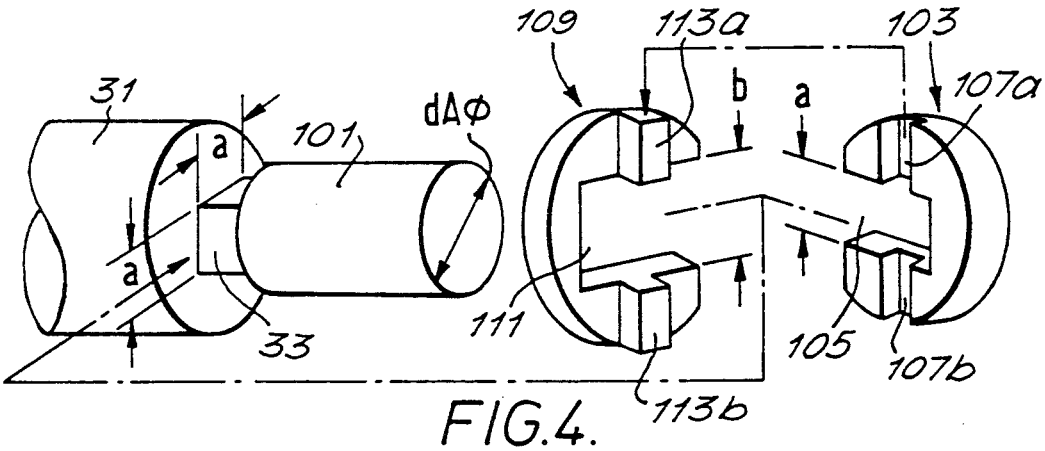
FIG. 4 is an exploded perspective view illustrating a rotational force transmitting mechanism of the fluid compressor shown in FIG. 3 with a main shaft of a rotary rod.

As shown in FIGS. 3 and 4, a main shaft 101 is rotatably inserted into bearing holes 25*a* formed in main bearing 25. The diameter dA$\phi$ of main shaft 101 is increased to a maximum value within a practicable range irrespective of the shape or the construction of rotational force transmitting mechanism S. The width and length of rectangular section 33 are the same as that in the conventional fluid compressor 11 shown in FIG. 1. However, the width and length of rectangular section 33 may be smaller than that in conventional fluid compressor 11. In either case, the diameter dA$\phi$ of main shaft 101 is considerably greater than the width or the length of rectangular section 33.

As shown in FIG. 4, an Oldham-ring 103 is a disk having a prescribed thickness and the diameter thereof is substantially the same as that of rotary rod 31. A rectangular shaped engaging hole 105 is formed in the center portion of Oldham-ring 103. The length of rectangular shaped engaging hole 105 is the same as that of rectangular section 33, i.e., "a". One of the sides of hole 105 in the width direction is opened, as shown in FIG. 4. First and second opposite rectangular grooves 107*a* and 107*b* are formed in one surface of Oldham-ring 103 at opposite sides of hole 105 along the length direction of hole 39. An Oldham-ring receiver 109 is a disk whose diameter is substantially the same as the inner diameter of cylinder 23, and thus Oldham-ring receiver 109 is fixed to the inner circumferential surface of cylinder 23 when receiver 109 is assembled into cylinder 23. A rectangular shaped guide hole 111 is formed at the center portion of Oldham-ring receiver 109. One of the sides of hole 11 in the width direction is opened, as shown in FIG. 4. The length of guide hole 111 is set at "b" greater than that of engaging hole 105, i.e., "a". In this case, the length "b" of guide hole 111 may be smaller than the diameter dA$\phi$ of main shaft 101.

First and second opposite rectangular projections 113*a* and 113*b* are integrally formed on the surface of Oldham-ring receiver 109 at opposite sides of guide hole 111 along the length direction of hole 11. First and second opposite rectangular projections 113*a* and 113*b* are slidably fitted into the corresponding first and second grooves 107*a* and 107*b* of Oldsham-ring 103, respectively when Oldham-ring 103 is mounted on Oldham-ring receiver 109. At this time, it is necessary that the open end of engaging hole 105 of Oldham-ring 103 is coincident with the open end of guide hole 11 of Oldham-ring receiver 109. Open ends of assembled Oldham-ring 103 and Oldham-ring receiver 109 are positioned opposite to the side of rectangular section 33 and assembled Oldham-ring 103 and Oldham-ring receiver 109 are pushed toward rectangular section 33. Thus, engaging hole 105 of Oldham-ring 103 and guide hole 111 of Oldham-ring receiver 109 are engaged with rectangular section 33 through each open end thereof. Then, rotary rod 31 mounting rotational force transmitting mechanism S thereon is smoothly inserted into cylinder 23 and Oldham-ring receiver 109 is fixed at a prescribed position in cylinder 23.

With the above-described embodiment, since Oldham-ring 103 and Oldham-ring receiver 109 respectively have an open end, and thus Oldham-ring 103 and Oldham-ring receiver 109 are easily assembled to rectangular section 33 of rotary rod 31 through each open end thoseof even though the diameter dA$\phi$ of main shaft 101 of rotary rod 31 is greater than the width or the length of rectangular section 33. Oldham-ring 103 and Oldham-ring receiver 109 surely carries out the operation in which the rotational force of cylinder 23 is transmitted to rotary rod 31 and the relative rotation between cylinder 23 and rotary rod 31 is executed. Furthermore, since the diameter dA$\phi$ of main shaft 101 is greater than that of the conventional fluid compressor, the pressure Pa acting on the edge surface of main shaft 101 is increased. The force in the direction reverse to the thrust force P acting on rotary rod 31 from the discharge side toward the suction side with the compressing operation of rotary rod 31 is increased and the thrust force P is surely canceled. Thus, occurrence of the frictional losses of rotary rod 31 can be avoided.

In the above-described embodiment, Oldham-ring receiver 109 is formed in a disk-shape. However, in a second embodiment shown in FIGS. 5 and 6, Oldham-ring receiver 109 is composed of a pair of pins 121*a* and 121*b*. In this embodiment, a pair of holes 123*a* and 123*b* is formed in Oldham-ring 125, instead of first and second opposite rectangular grooves 107*a* and 107*b* shown in FIG. 4, in the direction perpendicular to the inserting direction of Oldham-ring 125 to rectangular section 33.

Figure 5:
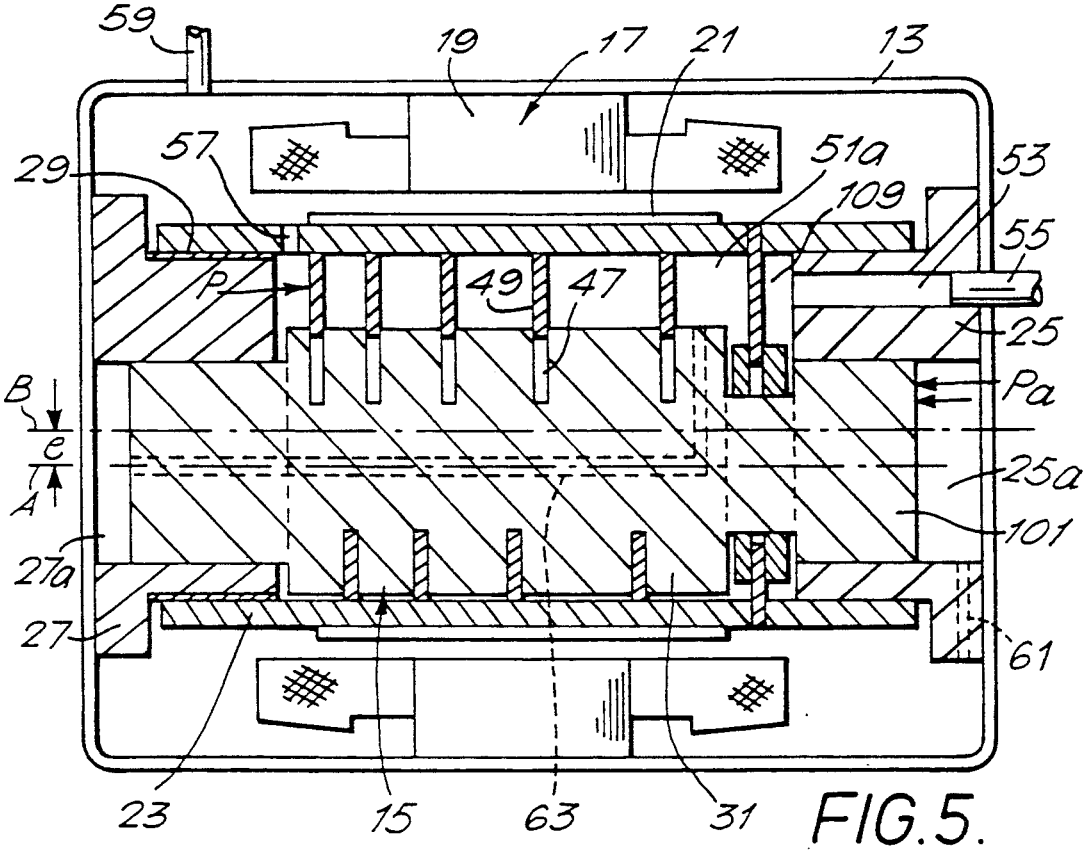
FIG. 5 is an exploded perspective view illustrating a fluid compressor of a second embodiment of the present invention.
Figure 6:
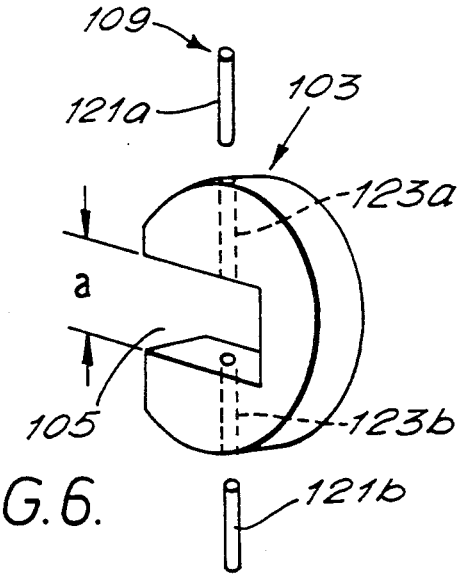
FIG. 6 is a perspective view of an Oldham-ring and a pair of pins shown in FIG. 5.

The pair of pins 121*a* and 121*b* is respectively inserted into the pair of holes 123*a* and 123*b* from the outside of cylinder 23 after rotary rod 31 is assembled to cylinder 23, as shown in FIG. 5.

Figure 7:
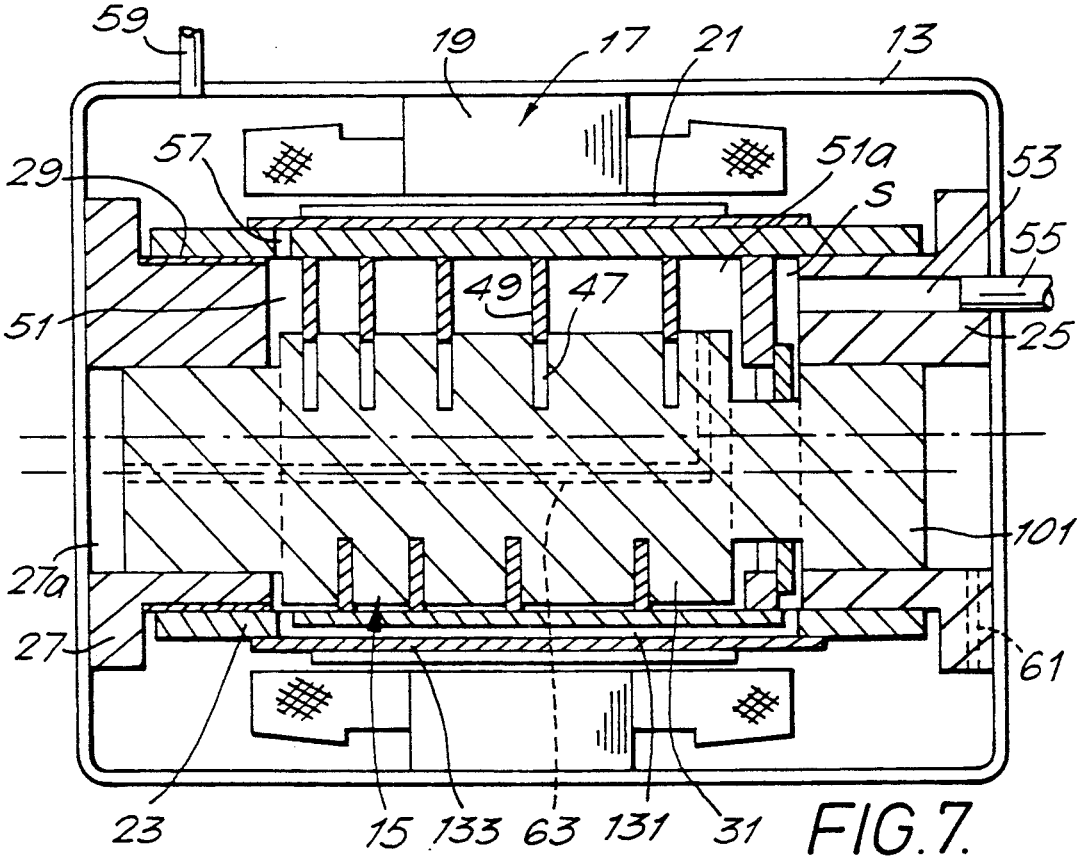
FIG. 7 is a cross sectional view illustrating a modification of one embodiment of the present invention.

As shown is FIG. 7, an oil supply groove 131 may be provided in cylinder 23. A cylindrical cover 133 is airtightly mounted on the outer circumferential surface of cylinder 23. Oil supply groove 131 is formed between the outer surface of cylinder 23 and the inner surface of cover 133 in the axial direction of rotary rod 31. One end of groove 131 is in communication with the discharge side of cylinder 23 and the other end thereof is in communication with the suction side of cylinder 23. Thus, a sufficient amount of oil is ensured in cylinder 23 and the lubricantion in cylinder 23 is enhanced.

In the present invention, since Oldham-ring and Oldham-ring receiver are engaged with the rectangular section from the direction perpendicular to the axial direction of the main shaft, an easy assembling of the Oldham-ring and Oldham-ring receiver to the rectangular section can be achieved. Furthermore, since the diameter of the main shaft of the rotary rod (rotary piston) is greater than that of the conventional fluid compressor, the pressure acting on the edge portion of the main shaft is increased. Thus, the force in the direction reverse to the thrust force acting on the rotary rod from the discharge side toward the suction side is increased and the thrust force can be effectively canceled.

The present invention has been described with respect to a specific embodiment. However, other embodiment based on the principles of the present invention should be obvious to those of ordinary skill in the art. Such embodiments are intended to be covered by the claims.

What is claimed is:

1. A fluid compressor comprising:

a rotatable cylinder having a suction side from which refrigerant having a first pressure is entered and a discharge side from which refrigerant having a second pressure greater than the first pressure is discharged;

driving means for generating a rotational force applied to the cylinder;

first and second bearings for respectively supporting the suction and discharge sides of the cylinder;

rotatable compressing means disposed in the cylinder for compressing refrigerant from the suction side toward the discharge side of the cylinder, the compressing means including a columnar main body having a defined length and first and second shafts each extending from opposite sides of the main body, the first and the second shafts having a defined length each rotatably inserted into the corresponding first and second bearings; and rotational force transmitting means for transmitting the rotational force from the cylinder to the compressing means, the transmitting means including;

a rectangular section formed between the main body and the first shaft of the compressing means, an Oldham-ring engaged with the rectangular section from the direction perpendicular to the first shaft, and an Oldham-ring receiver, by which the Oldham-ring is supported, engaged with the rectangular section from the direction perpendicular to the first shaft.

2. A compressor according to claim 1, wherein the Oldham-ring includes a disk-shaped body, a rectangular shaped engaging hole, whose one side is opened, at the center of the disk-shaped body, and a pair of grooves each formed on the disk-shaped body from the opposite sides of the engaging hole.

3. A compressor according to claim 2, wherein the rotatable cylinder has an inner diameter, and the Oldham-ring receiver includes a second disk-shaped body whose diameter is substantially equal to the inner diameter of the cylinder, a rectangular shaped guide hole, whose one side is opened, at the center of the second disk-shaped body, and a pair of projections each formed on the second disk-shaped body from the opposite sides of the guide hole, the pair of projections being engaged with the pair of grooves of the Oldham-ring so that the open side of guide hole is coincident to the open side of the engaging hole, the Oldham-ring receiver by which the Oldham-ring is supported being engaged with the rectangular section through the open side of the engaging hole in the direction perpendicular to the first shaft.

4. A compressor according to claim 1, wherein the columnar main body is eccentrically located in the cylinder so that a part of the outer circumferential surface of the main body is in contact with the inner circumferential surface of the cylinder in the axial direction thereof, and the rotatable compressor means includes a spiral groove formed in the outer circumferential surface of the main body so that the distance between the adjacent grooves in the axial direction of the main body is gradually decreased from the suction side toward the discharge side of the cylinder and a spiral blade movably fitted in the groove in substantially the radial direction of the main body, the spiral blade dividing a space between the outer circumferential surface of the main body and the inner circumferential surface of the cylinder into a plurality of operating chambers whose volumes are decreased from the suction side toward the discharge side of cylinder.

5. A compressor according to claim 4, wherein the compressing operation of the compressing means generates a thrust force acting on the main body of the compressing means in the extending direction of the first and second shafts, and the compressor further includes thrust force cancel means for canceling the thrust force during the operation.

6. A compressor according to claim 5, wherein the thrust force cancel means includes main pressure apply means for applying a third pressure greater than the first pressure to the edge surface of the first shaft and auxiliary pressure apply means associated with the main pressure apply means for applying a fourth pressure smaller than the second pressure to the edge surface of the second shaft for generating a counter thrust force.

7. A compressor according to claim 6, wherein the compressing means includes the first shaft having a diameter greater than the width of the rectangular section for increasing the counter thrust force.

8. A compressor according to claim 5, wherein the Oldham-ring includes a disk-shaped body, a rectangular shaped engaging hole, whose one side is opened, at the center of the disk-shaped body, and a pair of grooves each formed on the disk-shaped body from the opposite sides of the engaging hole.

9. A compressor according to claim 8, wherein the rotatable cylinder has an inner diameter, and the Oldham-ring receiver includes a second disk-shaped body whose diameter is substantially equal to the inner diameter of the cylinder, a rectangular shaped guide hole, whose one side is opened, at the center of the second disk-shaped body, and a pair of projections each formed on the second disk-shaped body from the opposite sides of the guide hole, the pair of projections being engaged with the pair of grooves of the Oldham-ring so that the open side of guide hole in coincident to the open side of the engaging hole, the Oldham-ring receiver by which the Oldham-ring is supported being engaged with the rectangular section through the open side of the engaging hole in the direction perpendicular to the first shaft.

10. A compressor according to claim 1, wherein the Oldham-ring includes a disk-shaped body, a rectangular shaped engaging hole, whose one side is opened, at the center of the disk-shaped body, and a pair of holes each oppositely formed in the circumferential surface of the disk-shaped body through the center of the disk-shaped body.

11. A compressor according to claim 10, wherein the cylinder has a pair of outer holes oppositely formed in the outer surface thereof, and the Oldham-ring receiver includes a pair of pins slidably inserted into the corresponding holes of the disk-shaped body through the pair of outer holes to support the Oldham-ring at a prescribed position in the cylinder.

12. A compressor according to claim 5, wherein the Oldham-ring includes a disk-shaped body, a rectangular shaped engaging hole, whose one side is opened, at the center of the disk-shaped body, and a pair of holes each oppositely formed in the circumferential surface of the disk-shaped body through the center of the disk-shaped body.

13. A compressor according to claim 12, wherein the cylinder has a pair of outer holes oppositely formed in the outer surface thereof, and the Oldham-ring receiver includes a pair of pins slidably inserted into the corresponding holes of the disk-shaped body through the pair of outer holes to support the Oldham-ring at a prescribed position in the cylinder.

* * * * *